US011561493B1

(12) United States Patent
Kojima et al.

(10) Patent No.: US 11,561,493 B1
(45) Date of Patent: Jan. 24, 2023

(54) TEMPERATURE CONTROL DEVICE AND IMAGE FORMING APPARATUS INCLUDING TEMPERATURE CONTROL DEVICE

(71) Applicant: TOSHIBA TEC KABUSHIKI KAISHA, Tokyo (JP)

(72) Inventors: Takeshi Kojima, Tagata Shizuoka (JP); Yutaka Usami, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/570,409

(22) Filed: Jan. 7, 2022

(51) Int. Cl.
*G03G 15/20* (2006.01)
*G03G 15/00* (2006.01)

(52) U.S. Cl.
CPC ..... *G03G 15/2039* (2013.01); *G03G 15/20* (2013.01); *G03G 15/205* (2013.01); *G03G 15/5004* (2013.01)

(58) Field of Classification Search
CPC ..... G03G 15/20; G03G 15/2039; G03G 15/205; G03G 15/5004
See application file for complete search history.

(56) References Cited

U.S. PATENT DOCUMENTS

2013/0279933 A1* 10/2013 Tanaka ..... G03G 15/205 399/70
2019/0235420 A1* 8/2019 Mochizuki ..... G03G 15/205
2021/0311421 A1* 10/2021 Yagi ..... G03G 15/2028
2021/0364956 A1 11/2021 Usami

FOREIGN PATENT DOCUMENTS

JP 08-95438 4/1996
JP 2009-156968 7/2009
JP 2015-052766 3/2015

* cited by examiner

*Primary Examiner* — Joseph S Wong
(74) *Attorney, Agent, or Firm* — Amin, Turocy & Watson LLP

(57) ABSTRACT

According to one embodiment, a temperature control device stores a fixing device temperature estimation value and a storage time obtained by WAE control in a memory at any time during operation. After an electric power supply to the temperature control device is stopped, the next time the electric power supply is started, an electric power supply stop period until the electric power supply is started is calculated. If the electric power supply stop period is shorter than a set time, the WAE control is started by using the stored fixing device temperature estimation value, and if the electric power supply stop period exceeds the set time, the WAE control is started based on an initial set value.

20 Claims, 8 Drawing Sheets

TEMPERATURE CONTROL DEVICE AND IMAGE FORMING APPARATUS INCLUDING TEMPERATURE CONTROL DEVICE

FIELD

Embodiments described herein relate generally to a temperature control device and an image forming apparatus including the temperature control device, and related methods.

BACKGROUND

An image forming apparatus includes a fixing device that fixes a toner image on a recording medium by applying heat and pressure to the recording medium to which the toner image is transferred. The fixing device includes a fixing rotating body (heat roller), a pressurizing member (press roller), a heating member (lamp, IH heater, or the like), a temperature sensor, and the like. The temperature sensor detects a temperature of the surface of the heat roller. The controller that controls the fixing device controls a surface temperature of the heat roller to be a target value by increasing or decreasing an electric power amount supplied to the heating member based on a detection signal (temperature sensor signal) of the temperature sensor.

In addition, in recent years, an image forming apparatus equipped with a temperature control device that obtains an estimated temperature value of a heat roller and controls the temperature is proposed. If the image forming apparatus is restarted in a state where the temperature of the heat roller is high, the temperature estimation value generated before the stop is reset. Due to this reset, in some cases, even if the actual temperature of the heat roller is high, the temperature estimation value is estimated as the initial state, so that an error may occur. For this reason, at the time of restart, it is necessary to calculate the temperature estimation value in consideration of the actual temperature of the heat roller.

DETAILED DESCRIPTION

Figure 1:
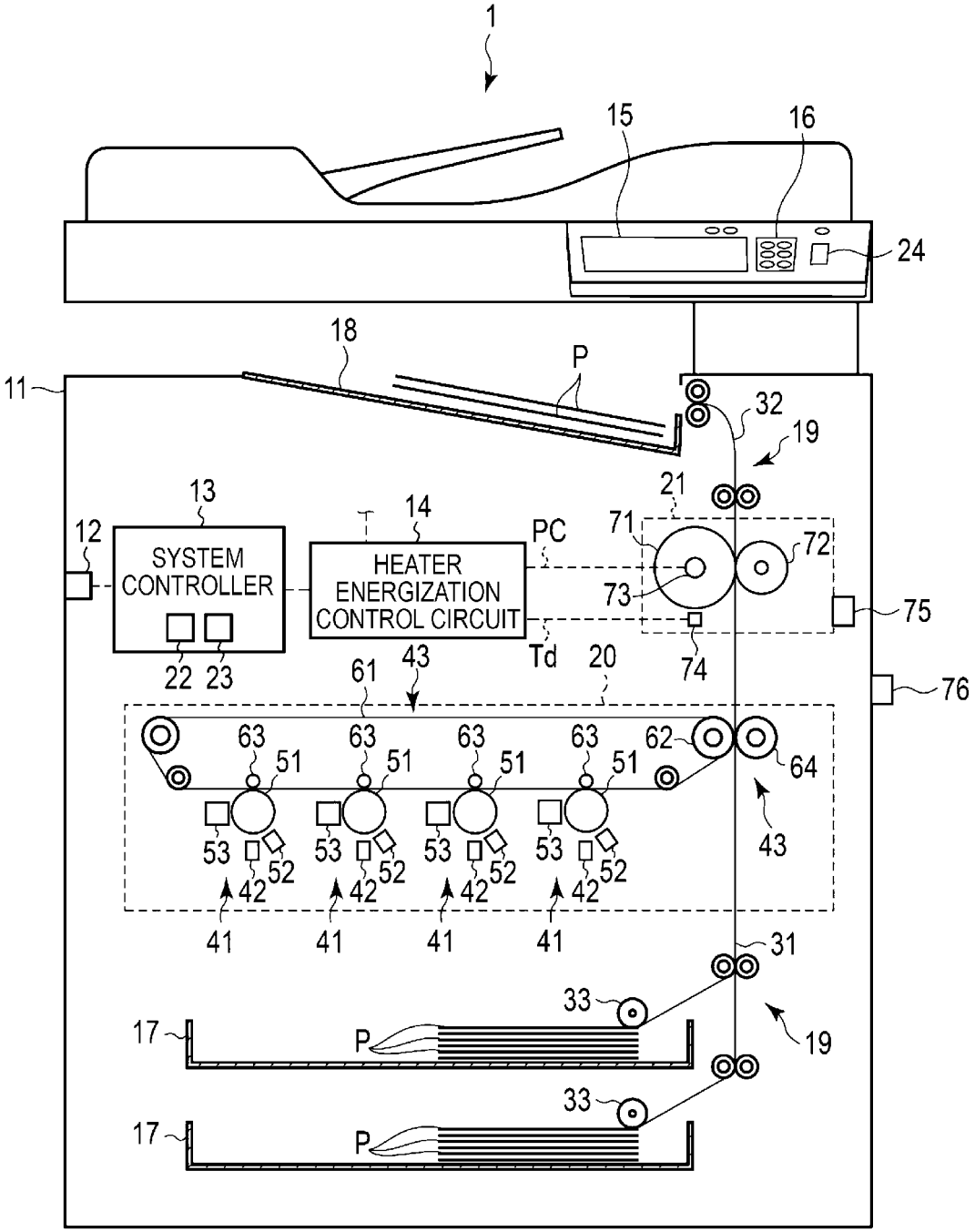
FIG. 1 is a diagram conceptually illustrating an overall configuration example of an image forming apparatus according to a first embodiment.

In general, according to one embodiment, a temperature control device stores a fixing device temperature estimation value obtained by WAE control during operation and an estimation time thereof in a non-volatile memory so as to be updated at any time. After electric power supply for heating a heat roller of a fixing device, which is a temperature control target of the temperature control device, is stopped (powered off, or the like), and after that, if the electric power supply to the heat roller is started by turning on the power or the like, the electric power supply stop period from when a previous electric power supply is stopped to when the electric power supply is started is obtained. If the electric power supply stop period is shorter than a preset set time, the temperature (temperature estimation value) of the fixing device is allowed to be higher than an initial set value, and the WAE control is started by using the stored fixing device temperature estimation value Tt. In addition, if the electric power supply stop period exceeds the set time, the WAE control is started by using the initial set value by allowing the temperature (temperature estimation value) of the fixing device to be a room temperature. It is noted that the weighted average control with estimate temperature (WAE) control is a technique for simulating a temperature of a member which is a temperature control target as a thermal CR circuit as described later, and by estimating (calculating) a surface temperature of the heat roller which is the temperature control target from a heat capacity (C) of the heat roller to be heated, a heat resistance (R) of the fixing device, the energy input to the fixing device, or the like, temperature control is performed. According to another embodiment, a temperature control method for an image forming apparatus involves estimating a temperature of a temperature control target based on energization of a heater; an estimation value storage component configured to updating a temperature estimation value based on a temperature estimation result estimated and an estimated estimation time at each set time and store the temperature estimation value; calculating a supply stop period from the estimation time to a time when the start instruction is input and compare the supply stop period with a predetermined set time when a new start instruction is input after electric power supply is stopped; determining that the temperature estimation value stored is used for temperature control if the supply stop period is shorter than the set time; determining that a preset initial set value is used for the temperature control if the supply stop period is equal to or longer than the set time; and outputting an energization pulse for controlling the electric power supplied to the heater based on the temperature estimation value, the initial set value, or the temperature estimation result.

Hereinafter, embodiments will be described in detail with reference to the drawings.

First Embodiment

Figure 2:
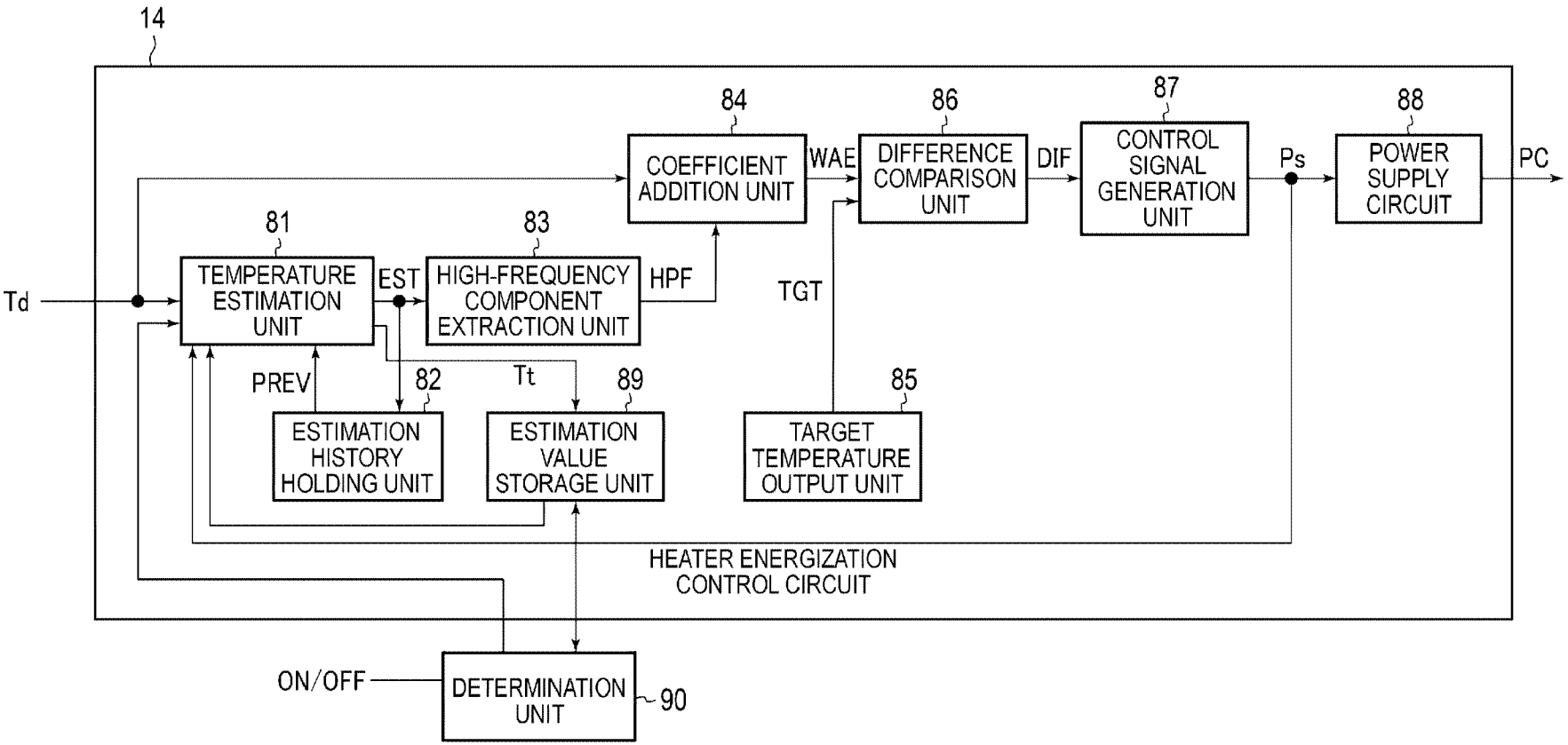
FIG. 2 is a block diagram illustrating a configuration example of a temperature control device.

Hereinafter, a temperature control device and an image forming apparatus according to the first embodiment will be described with reference to the drawings. FIG. 1 is a diagram conceptually illustrating an overall configuration example of the image forming apparatus according to the first embodiment, and FIG. 2 is a block diagram illustrating a configuration example of the temperature control device.

The image forming apparatus 1 is, for example, a multifunction printer (MFP) that performs various processes such as image forming while conveying the recording medium such as printing paper. Alternatively, the image forming apparatus 1 is a solid-state scanning type printer (for example, an LED printer) that scans an LED array that performs various processes such as image forming while conveying a recording medium. These image forming apparatuses 1 have, for example, a configuration in which a toner is received from a toner cartridge and an image is formed on the recording medium by the received toner. The toner may be a monochromatic toner or may be a plurality of color toners such as cyan, magenta, yellow, and black. In addition, the toner may be a decolorable toner that decolorizes if heat is applied after printing.

As illustrated in FIG. 1, the image forming apparatus 1 includes a housing 11, a communication interface 12, a system controller 13, a heater energization control circuit 14, a display unit 15, an operation interface 16, a plurality of paper trays 17, a paper ejection tray 18, and a conveying unit 19, an image forming unit 20, a fixing device 21, and a main power switch 24.

The housing 11 is a main body of the image forming apparatus 1. The housing 11 accommodates the communication interface 12, the system controller 13, the heater energization control circuit 14, the display unit 15, the operation interface 16, the plurality of paper trays 17, the paper ejection tray 18, the conveying unit 19, the image forming unit 20, and the fixing device 21.

First, a configuration of a control system of the image forming apparatus 1 will be described.

The communication interface 12 is a connection device that enables communication with other devices such as a host device (external device). The communication interface 12 includes, for example, a network connection terminal such as a LAN connector. In addition, the communication interface 12 may have a function of wirelessly communicating with other devices in accordance with a standard such as Bluetooth (registered trademark) or Wi-fi (registered trademark).

The system controller 13 controls the image forming apparatus 1.

The system controller 13 includes, for example, a processor 22 and a memory 23.

The processor 22 is an arithmetic element such as a CPU and executes arithmetic processes.

As the memory 23, a non-volatile memory that can be only read such as a read only memory (ROM), a non-volatile memory that can be written and read at any time such as a flash ROM, a solid state drive (SSD), and a hard disk drive (HDD), and a volatile memory that can be written and read at any time such as random access memory (RAM) can be applied, and an appropriate combination among these memories can be used. The memory 23 stores a program, data used in the program, and the like. The memory 23 also functions as a working memory. That is, the memory 23 temporarily stores the data being processed by the processor 22 and the program executed by the processor 22, and the like.

The processor 22 functions as a control unit capable of executing various operations by executing the program stored in the memory 23. In addition, the processor 22 executes various arithmetic processes and processes related to determination by using the data stored in the memory 23.

In the present embodiment, the processor 22 includes functions of a determination unit 90, which will be described later. The determination unit 90 compares the calculated electric power supply stop period with a preset set time and determines whether or not the fixing device 21 is in a room temperature (or a normal temperature) state. Based on the determination result, it is selected whether to start the WAE control using the stored fixing device temperature estimation value or the WAE control using a normal initial set value.

In addition, for example, the processor 22 generates a print job based on an image acquired from an external device via the communication interface 12. The processor 22 stores the generated print job in the memory 23. The print job includes an image data indicating an image formed on the recording medium P. The image data may be data for forming an image on one recording medium P or may be data for forming an image on a plurality of recording media P. Furthermore, the print job includes information indicating whether the print is a color print or a monochrome print. In addition, furthermore, the print job may contain information such as the number of copies to be printed (the number of page sets) and the number of prints (the number of pages) per copy.

In addition, the processor 22 generates print control information for controlling operations of the conveying unit 19, the image forming unit 20, and the fixing device 21 based on the generated print job. The print control information includes information indicating the timing of paper passing. The processor 22 transmits the print control information to the heater energization control circuit 14.

In addition, the processor 22 functions as a controller (engine controller) that controls the operations of the conveying unit 19 and the image forming unit 20 by executing the program stored in the memory 23. That is, the processor 22 controls the conveyance of the recording medium P by the conveying unit 19, the image formation on the recording medium P by the image forming unit 20, and the like.

It is noted that the image forming apparatus 1 may individually include the engine controller and the system controller 13. In this case, the engine controller controls the conveyance of the recording medium P by the conveying unit 19, the image formation on the recording medium P by the image forming unit 20, and the like. In addition, in this case, the system controller 13 supplies information necessary for controlling operations to the engine controller.

In addition, the image forming apparatus 1 includes an electric power conversion circuit (not illustrated) that supplies a DC voltage to each component in the image forming apparatus 1 by using an AC voltage of an AC power supply AC. The electric power conversion circuit supplies the DC voltage required for the operations of the processor 22 and the memory 23 to the system controller 13. In addition, the electric power conversion circuit supplies the DC voltage required for the image formation to the image forming unit 20. In addition, the electric power conversion circuit supplies the DC voltage required for conveying the recording medium to the conveying unit 19. In addition, the electric power conversion circuit supplies the DC voltage for driving the heater 73 of the fixing device 21 to the heater energization control circuit 14.

The heater energization control circuit 14 is included in the temperature control device of the present embodiment. The heater energization control circuit 14 generates an electric power PC and supplies an electric power PC to the heater 73 of the fixing device 21. A detailed description of the heater energization control circuit 14 will be described later.

The display unit 15 includes a display that displays a screen in response to a video signal input from a display control unit such as a system controller 13 or a graphic controller (not illustrated).

For example, screens for various settings of the image forming apparatus 1 are displayed on the display of the display unit 15.

The main power switch 24 is a switch that supplies and cuts off the electric power for driving the image forming apparatus 1 by an ON and OFF operation. By the ON operation of the main power switch 24, the image forming apparatus 1 is started, and by the OFF operation, the image forming apparatus 1 stops driving.

The operation interface 16 is connected to an operation member (not illustrated). The operation interface 16 supplies an operation signal corresponding to the operation of the operation member to the system controller 13. The operation member is, for example, a touch sensor, a numeric keypad, a paper feed key, various function keys, a keyboard, or the like. The touch sensor acquires information indicating a designated position within a certain area. The touch sensor is configured as a touch panel integrally with the display unit 15, so that a signal indicating the touched position on the screen displayed on the display unit 15 is input to the system controller 13.

The plurality of paper trays 17 are cassettes that are detachably attached to the housing 11 and houses the recording media P of the same size or different sizes in units of each cassette. The paper tray 17 supplies the recording medium P to the conveying unit 19. In addition, the paper ejection tray 18 is a tray that supports the recording media P ejected from the image forming apparatus 1.

Next, a configuration for conveying the recording medium P of the image forming apparatus 1 will be described.

The conveying unit 19 is a mechanism for conveying the recording medium P in the image forming apparatus 1. As illustrated in FIG. 1, the conveying unit 19 includes a plurality of conveyance paths. For example, the conveying unit 19 includes a paper feed conveyance path 31 and a paper ejection conveyance path 32.

Each of the paper feed conveyance path 31 and the paper ejection conveyance path 32 is configured with a plurality of motors, a plurality of rollers, and a plurality of guides (not illustrated). Under the control of the system controller 13, the plurality of motors rotate shafts to rotate the rollers that follow the rotation of the shaft. The plurality of rollers move the recording medium P by rotating. The plurality of guides prevent skewing of the recording medium P during conveyance.

The paper feed conveyance path 31 takes in the recording medium P from each paper tray 17 by a pickup roller 33 and supplies each of the taken-in recording media P to the image forming unit 20.

The paper ejection conveyance path 32 is a conveyance path for ejecting the recording medium P on which the image is formed from the housing 11. The recording medium P ejected through the paper ejection conveyance path 32 is housed in the paper ejection tray 18.

Next, the image forming unit 20 will be described.

The image forming unit 20 forms an image on the recording medium P based on the print job generated by the processor 22. The image forming unit 20 includes a plurality of process units 41, a plurality of exposure devices 42, and a transfer mechanism 43. The image forming unit 20 includes the exposure device 42 for each process unit 41. It is noted that the plurality of process units 41 and the plurality of exposure devices 42 have the same configuration.

First, the process unit 41 will be described.

The toner cartridges that supply toner with different colors are connected to the process unit 41, and thus, the process unit 41 forms the toner image. The plurality of process units 41 are provided for respective colors of the toners and, for example, correspond to color toners such as cyan, magenta, yellow, and black, respectively. The toner cartridge includes a toner container and a toner delivery mechanism. The toner container is a container for supplying the toner to be contained. The toner delivery mechanism is a mechanism configured with a screw and the like that delivers the toner in the toner container.

Hereinafter, a set of the process unit 41 and the exposure device 42 will be described as representative examples.

The process unit 41 includes a photoconductive drum 51, an electrostatic charger 52, and a developing device 53.

The photoconductive drum 51 is a photoreceptor configured with a cylindrical drum and a photoconductive layer formed on an outer peripheral surface of the drum. The photoconductive drum 51 is rotated at a constant speed by a drive mechanism (not illustrated).

The electrostatic charger 52 uniformly charges a surface of the photoconductive drum 51. For example, the electrostatic charger 52 charges the photoconductive drum 51 to a uniform negative polarity potential (contrast potential) by applying a voltage (development bias voltage) to the photoconductive drum 51 by using a charging roller. The charging roller is rotated by following the rotation of the photoconductive drum 51 in a state where a predetermined pressure is applied to the photoconductive drum 51.

The developing device 53 is a device for attaching toner to the photoconductive drum 51. The developing device 53 includes a developer container, a stirring mechanism, a developing roller, a doctor blade, an auto toner control (ATC) sensor, and the like. The developer container is a container that receives and contains the toner delivered from the toner cartridge. A carrier is contained in the developer container in advance. The toner delivered from the toner cartridge is stirred with the carrier by the stirring mechanism to form the developer in which the toner and the carrier are mixed. The carrier is contained in the developer container during the manufacture of the developing device 53.

The developing roller rotates in the developer container to attach the developer to the surface thereof. The doctor blade is a member disposed at a predetermined distance away from the surface of the developing roller. The doctor blade partially removes the top side of the developer attached to the surface of the rotating developing roller. Accordingly, a layer of the developer having a constant thickness corresponding to the distance between the doctor blade and the surface of the developing roller is formed on the surface of the developing roller.

The ATC sensor is, for example, a magnetic flux sensor having a coil and detecting a voltage value generated in the coil. The detection voltage of the ATC sensor changes depending on the density of the magnetic flux from the toner in the developer container. That is, the system controller 13 determines the concentration ratio (toner concentration ratio) of the toner remaining in the developer container to the carrier based on the detection voltage of the ATC sensor. The system controller 13 operates a motor (not illustrated) that drives the toner cartridge delivery mechanism based on the toner concentration ratio to deliver the toner from the toner cartridge to the developer container of the developing device 53.

Next, the exposure device 42 will be described.

The exposure device 42 includes a plurality of light emitting elements. The exposure device 42 forms a latent image on the photoconductive drum 51 by irradiating the charged photoconductive drum 51 with light from the light emitting element. The light emitting element is, for example, a light emitting diode (LED) or the like. One light emitting element is configured to irradiate one point on the photoconductive drum 51 with light. The plurality of light emitting elements are arranged in the main scanning direction, which is a direction parallel to the rotation axis of the photoconductive drum 51.

The exposure device 42 forms a latent image for one line on the photoconductive drum 51 by irradiating the photoconductive drum 51 with light by the plurality of light emitting elements arranged in the main scanning direction. Furthermore, the exposure device 42 forms the latent image for a plurality of lines by continuously irradiating the rotating photoconductive drum 51 with light.

In the process unit 41 having the above-described configuration, if the surface of the photoconductive drum 51 charged by the electrostatic charger 52 is irradiated with light from the exposure device 42, an electrostatic latent image is formed. Furthermore, if the layer of the developer formed on the surface of the developing roller is close to the surface of the photoconductive drum 51, the toner contained in the developer is attached to the latent image formed on the surface of the photoconductive drum 51. Accordingly, the toner image is formed on the surface of the photoconductive drum 51.

Next, the transfer mechanism 43 will be described.

The transfer mechanism 43 transfers the toner image formed on the surface of the photoconductive drum 51 to the recording medium P. The transfer mechanism 43 includes, for example, a primary transfer belt 61, a secondary transfer facing roller 62, a plurality of primary transfer rollers 63, and a secondary transfer roller 64.

The primary transfer belt 61 is an endless belt wound around the secondary transfer facing roller 62 and a plurality of winding rollers. In the primary transfer belt 61, the inner surface (inner peripheral surface) is in contact with the secondary transfer facing roller 62 and the plurality of winding rollers, and the outer surface (outer peripheral surface) is opposed to the photoconductive drum 51 of the process unit 41.

The secondary transfer facing roller 62 is rotated by a motor (not illustrated). The secondary transfer facing roller 62 rotates to convey the primary transfer belt 61 in a predetermined conveying direction. The plurality of winding rollers are configured to be freely rotatable. The plurality of winding rollers are rotated according to the movement of the primary transfer belt 61 by the secondary transfer facing roller 62.

Each of the plurality of primary transfer rollers 63 allows the primary transfer belt 61 to come into contact with the photoconductive drum 51 of the process unit 41. Specifically, the plurality of primary transfer rollers 63 are provided at positions facing the photoconductive drums 51 of the process units 41 corresponding to each primary transfer roller 63 with the primary transfer belt 61 interposed therebetween. The primary transfer roller 63 comes into contact with the inner peripheral surface side of the primary transfer belt 61 and displaces the primary transfer belt 61 toward the photoconductive drum 51. Accordingly, the primary transfer roller 63 allows the outer peripheral surface of the primary transfer belt 61 to be in contact with the photoconductive drum 51.

The secondary transfer roller 64 is provided at a position facing the primary transfer belt 61. The secondary transfer roller 64 comes into contact with the outer peripheral surface of the primary transfer belt 61 and applies pressure. Accordingly, a transfer nip is formed in which the secondary transfer roller 64 and the outer peripheral surface of the primary transfer belt 61 are in close contact with each other. If the recording medium P passes, the secondary transfer roller 64 presses the recording medium P passing through the transfer nip against the outer peripheral surface of the primary transfer belt 61.

The secondary transfer roller 64 and the secondary transfer facing roller 62 rotate to convey the recording medium P supplied from the paper feed conveyance path 31 in a state of interposing the recording medium P. Accordingly, the recording medium P passes through the transfer nip.

In the transfer mechanism 43 having the above-described configuration, if the outer peripheral surface of the primary transfer belt 61 comes into contact with the photoconductive drum 51, the toner image formed on the surface of the photoconductive drum is transferred to the outer peripheral surface of the primary transfer belt 61. If the image forming unit 20 includes a plurality of the process units 41, the toner image is transferred from the photoconductive drums 51 of the plurality of process units 41 to the outer peripheral surface of the primary transfer belt 61. The transferred toner image is conveyed by the primary transfer belt 61 to the transfer nip in which the secondary transfer roller 64 and the outer peripheral surface of the primary transfer belt 61 are in close contact with each other. If the recording medium P is present in the transfer nip, the toner image transferred to the outer peripheral surface of the primary transfer belt 61 is transferred to the recording medium P in the transfer nip.

Next, a configuration related to fixing of the image forming apparatus 1 will be described.

The fixing device 21 fixes the toner image on the recording medium P to which the toner image is transferred. The fixing device 21 operates based on the control of the system controller 13 and the heater energization control circuit 14. The fixing device 21 includes a fixing rotating body, a pressurizing member, and a heating member. The fixing rotating body, which is the temperature control target, is a heat roller 71 rotated by a motor (not illustrated). The heat roller 71 is heated by the heater 73. Therefore, the temperature of the heat roller 71 is controlled by adjusting the electric power supplied to the heater 73. The pressurizing member is, for example, a press roller 72. In addition, furthermore, the fixing device 21 includes a temperature sensor (thermal sensor) 74 that detects a temperature of the surface of the heat roller 71.

The heat roller 71 has a core metal made of a metal having a hollow shape and an elastic layer formed on the outer periphery of the core metal. In the heat roller 71, the inside of the core metal is heated by the heater 73 disposed inside the core metal formed in a hollow shape. The heat generated inside the core metal is transferred to the outside surface of the heat roller 71 (that is, the surface of the elastic layer).

The press roller 72 is provided at a position facing the heat roller 71. The press roller 72 has a core metal made of metal having a predetermined outer diameter and an elastic layer formed on an outer periphery of the core metal. The press roller 72 applies pressure to the heat roller 71 by the stress applied from a tension member (not illustrated). If the pressure is applied from the press roller 72 to the heat roller 71, a nip (fixing nip) in which the press roller 72 and the heat roller 71 are in close contact with each other is formed. The press roller 72 is rotated by a motor (not illustrated). The press roller 72 rotates to move the recording medium P entering the fixing nip and presses the recording medium P against the heat roller 71.

The heater 73 is a device that generates heat by the electric power PC supplied from the heater energization control circuit 14. The heater 73 is, for example, a halogen heater. The electric power PC from the heater energization control circuit 14 is supplied to the halogen heater, and thus, the halogen heater generates an electromagnetic wave. The inside of the core metal of the heat roller 71 is radiated with the electromagnetic wave, and then the heat roller 71 generates heat. Alternatively, the heater 73 may be, for example, an IH heater or the like.

The temperature sensor 74 detects the temperature of air in the vicinity of the surface of the heat roller 71. The number of temperature sensors 74 may be plural. For example, the plurality of temperature sensors 74 may be arranged in parallel to the rotation axis of the heat roller 71. It is noted that the temperature sensor 74 may be provided at least at a position where a change in the temperature of the heat roller 71 can be detected. The temperature sensor 74 supplies the temperature detection result Td indicating the detection result to the heater energization control circuit 14.

As described above, the heat roller 71 and the press roller 72 of the fixing device 21 apply heat and pressure to the recording medium P passing through the fixing nip. The toner on the recording medium P is melted by the heat applied by the heat roller 7, and is applied to the surface of the recording medium P by the pressure applied by the heat roller 71 and the press roller 72. Accordingly, the toner image is fixed on the recording medium P passing through the fixing nip. The recording medium P passing through the fixing nip is introduced into the paper ejection conveyance path 32 and ejected to the outside of the housing 11.

Next, the temperature control device will be described.

The temperature control device is configured with the determination unit 90 provided in the processor 22 in the system controller 13 of the image forming apparatus 1 and the heater energization control circuit 14. It is noted that, in the example, the determination unit 90 is described as an example of the configuration in which the determination unit 90 is provided in the processor 22, but the exemplary embodiments are not limited thereto, and the determination unit 90 may be provided in the heater energization control circuit 14 or may be provided in other control units.

The heater energization control circuit 14 controls the electric power PC supplied to the heater 73 of the fixing device 21. The heater energization control circuit 14 generates the electric power PC and supplies the electric power PC to the heater 73 of the fixing device 21. In the heater 73, the generated heat amount is adjusted according to the electric power amount of the electric power PC, and the temperature of the heat roller 71 is controlled.

As illustrated in FIG. 2, the heater energization control circuit 14 includes a temperature estimation unit 81, an estimation history holding unit 82, a high-frequency component extraction unit 83, a coefficient addition unit 84, a target temperature output unit 85, a difference comparison unit 86, a control signal generation unit 87, a power supply circuit 88, and an estimation value storage unit 89. In addition, the temperature detection result Td from the temperature sensor 74 is input to the heater energization control circuit 14.

The temperature estimation unit 81 performs a temperature estimation process of estimating the temperature of the surface of the heat roller 71. The temperature detection result Td from the temperature sensor 74, an estimation history PREV from the estimation history holding unit 82 described later, an energization pulse Ps from the control signal generation unit 87 described later, a fixing device temperature estimation value from the estimation value storage unit 89, and a determination signal described later from the determination unit 90 are input to the temperature estimation unit 81.

At the start of the WAE control, the temperature estimation unit 81 generates the temperature estimation result EST based on either the temperature detection result Td or the fixing device temperature estimation value Tt, the estimation history PREV, and the energization pulse Ps. In addition, the temperature estimation unit 81 includes a temperature sensor 76 provided on an exterior surface or frame of the image forming apparatus 1 to detect the room temperature, and the fixing device temperature estimation value Tt is calculated from the room temperature detected by the temperature sensor 76 and the estimated temperature value of the heat roller 71. In addition, the temperature estimation unit 81 may have a configuration where the temperature estimation result EST is generated based on the temperature detection result Td or the fixing device temperature estimation value Tt, the estimation history PREV, the energization pulse Ps, and the voltage (rated voltage) applied to the heater 73 if the energization pulse Ps is ON. The temperature estimation unit 81 outputs the temperature estimation result EST to the estimation history holding unit 82, and the high-frequency component extraction unit 83 and stores the fixing device temperature estimation value Tt in the estimation value storage unit 89.

The estimation history holding unit 82 holds the history of the temperature estimation result EST. The estimation history holding unit 82 outputs the estimation history PREV, which is a history of the temperature estimation result EST (past temperature estimation result EST), to the temperature estimation unit 81.

The high-frequency component extraction unit 83 performs a high-pass filter process for extracting the high-frequency component of the temperature estimation result EST. The high-frequency component extraction unit 83 outputs the high-frequency component HPF, which is a signal indicating the extracted high-frequency component, to the coefficient addition unit 84.

The coefficient addition unit 84 performs a coefficient addition process for correcting the temperature detection result Td. The temperature detection result Td from the temperature sensor 74 and the high-frequency component HPF from the high-frequency component extraction unit 83 are input to the coefficient addition unit 84. The coefficient addition unit 84 corrects the temperature detection result Td based on the high-frequency component HPF. Specifically, the coefficient addition unit 84 multiplies the high-frequency component HPF by a preset coefficient and adds the high-frequency component HPF multiplied by the coefficient to the temperature detection result Td to calculate a corrected temperature value WAE. The coefficient addition unit 84 outputs the corrected temperature value WAE to the difference comparison unit 86.

The target temperature output unit 85 outputs a preset target temperature TGT to the difference comparison unit 86.

The difference comparison unit 86 performs a difference calculation process. The difference comparison unit 86 calculates a difference DIF between the target temperature TGT from the target temperature output unit 85 and the corrected temperature value WAE from the coefficient addition unit 84 and outputs the difference DIF to the control signal generation unit 87.

The control signal generation unit 87 generates an energization pulse Ps, which is a pulse signal for controlling energization to the heater 73, based on the difference DIF.

The control signal generation unit 87 outputs the energization pulse Ps to the power supply circuit 88 and the temperature estimation unit 81.

The power supply circuit 88 supplies the electric power PC to the heater 73 based on the energization pulse Ps. The power supply circuit 88 performs energization to the heater 73 of the fixing device 21 by using a DC voltage supplied from an electric power conversion circuit (not illustrated). The power supply circuit 88 supplies the electric power PC to the heater 73 by switching between a state in which the DC voltage from the electric power conversion circuit is supplied to the heater 73 and a state in which the DC voltage from the electric power conversion circuit is not supplied to the heater 73, for example, based on the energization pulse Ps. That is, the power supply circuit 88 changes the energization time of the fixing device 21 to the heater 73 according to the energization pulse Ps.

It is noted that the power supply circuit 88 may be integrally configured with the fixing device 21. That is, the heater energization control circuit 14 may have a configuration of supplying the energization pulses Ps to the power supply circuit of the heater 73 of the fixing device 21 instead of supplying the electric power PC to the heater 73.

The estimation value storage unit 89 stores data so as to be updated together with the fixing device temperature estimation value Tt of the fixing device to be estimated by the temperature estimation unit 81 and the estimated estimation time at each preset certain time. The estimation value storage unit 89 basically stores the estimation time together with the latest fixing device temperature estimation value Tt, although the estimation value storage unit 89 depends on the length of the certain time.

The determination unit 90 reads the estimation time stored in the estimation value storage unit 89 if the image forming apparatus 1 is started from a stopped state or restarted from a sleep state. The determination unit 90 obtains the stop time (electric power supply stop period) from the estimation time to the electric power supply start time by turning on or restarting the power.

Next, the determination unit 90 compares the electric power supply stop period with the preset set time, and if the electric power supply stop period is shorter than the set time, the determination unit 90 determines that the temperature of the fixing device 21 is not dropped to the room temperature. According to the determination, the WAE control is started by using the fixing device temperature estimation value Tt stored in the estimation value storage unit 89, and the temperature estimation result EST is generated by the temperature estimation unit 81.

On the other hand, in the above-described comparison, the determination unit 90 determines that the temperature of the fixing device 21 drops to the room temperature if the electric power supply stop period is equal to or longer than the set time. According to the determination, the temperature estimation result EST is generated by the temperature estimation unit 81 by allowing the normal WAE control based on the initial set value (for example, the room temperature) to be started without using the fixing device temperature estimation value Tt stored in the estimation value storage unit 89.

It is noted that the electric power supply stop period is a period in which the electric power supply to the heat roller 71 of the fixing device 21 is stopped up to the start or restart. The set time described later is a time corresponding to a cooling period until the fixing device 21 returns to the room temperature. In addition, the initial set value can be set in any manner, and in the example, the initial set value is set to a room temperature (approximately 30° C.).

In addition, the set time used by the determination unit 90 for determination is a time taken for fixing device 21 to return from the temperature of the fixing device 21 in the operating state (for example, 50 to 60° C.) to the room temperature and can be obtained by actual measurement although the set time depends on the specifications and structure of the device. The set time may be set to any value and may be set to, for example, 60 minutes as illustrated in FIG. 3.

Figure 3:
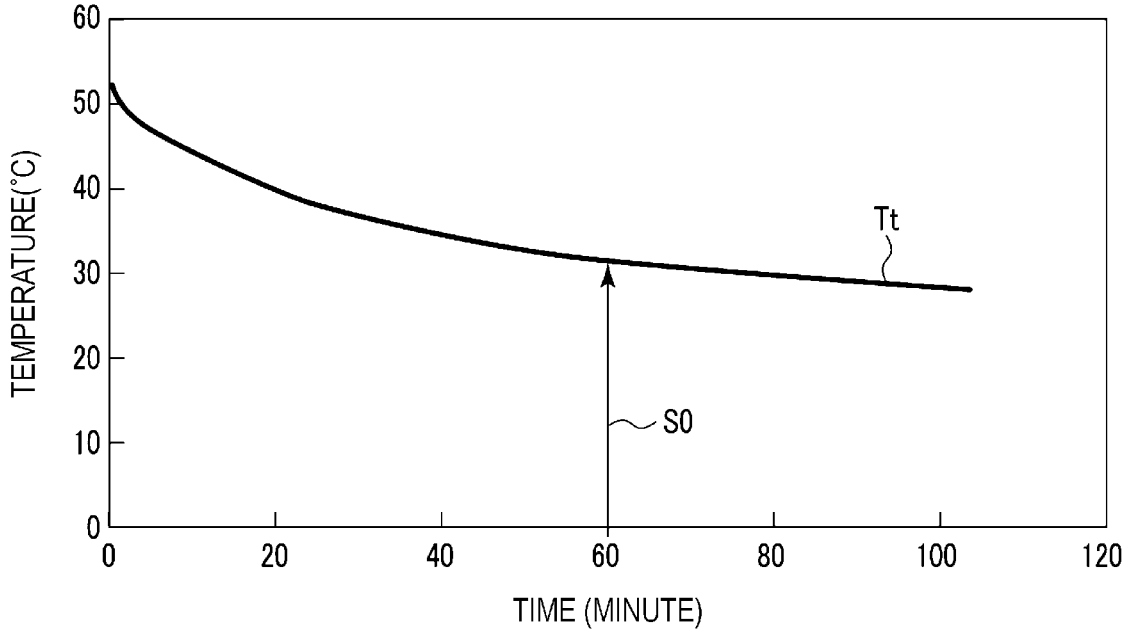
FIG. 3 is a diagram illustrating a temperature characteristic in which a temperature estimation value of a fixing device drops to room temperature.

FIG. 3 illustrates a temperature characteristic in which the temperature of the fixing device 21 drops to the room temperature if the temperature of the fixing device 21 in operation is set to approximately 55° C. In the example, since it takes about 60 minutes for the temperature of the fixing device 21 to drop to about 30° C. at the room temperature, the set time is set to 60 minutes.

It is noted that the stopped state of the image forming apparatus 1 in the present embodiment is a state in which the electric power supply to the heater 73 is stopped and, specifically, includes a state in which the main power switch 24 is turned off at the end of printing, a state in which the power supply is stopped due to power failure, a state in which the electric power supply is stopped due to the sleep setting (standby state), a state in which the power supply is stopped at the time of warming up after the image forming apparatus 1 is started, and a state in which the electric power supply to the heater 73 is stopped due to other settings, for example, a maintenance work setting including part replacement during starting. In addition, the start and restart indicate a state in which the electric power supply to the heater 73 is started, and includes a state in which the main power switch 24 is turned on, a state in which the sleep state is returned to the operating state, and the like.

As described above, if the heater energization control circuit 14 is restarted by turning on the main power switch or returning from the sleep state after the electric power supply to the heater 73 is stopped, the heater energization control circuit 14 estimates the temperature of the fixing device 21 based on the length of the period if the previous electric power supply is stopped and determines whether or not to use the fixing device temperature estimation value stored before the stop to start the driving of the temperature estimation unit 81. Accordingly, the heater energization control circuit 14 starts supplying electric power (warming up) to the heater 73 in consideration of the temperature of the fixing device 21.

The heater energization control circuit 14 adjusts the electric power amount to the heater 73 of the fixing device 21 based on the temperature detection result Td, the temperature estimation history PREV, and the energization pulse Ps. Such control is called weighted average control with estimate temperature (WAE) control. It is noted that the temperature estimation unit 81, the estimation history holding unit 82, the high-frequency component extraction unit 83, the coefficient addition unit 84, the target temperature output unit 85, the difference comparison unit 86, and the control signal generation unit 87 of the heater energization control circuit 14 may be configured by an electric circuit or by software.

[Wae Control]

Figure 4:
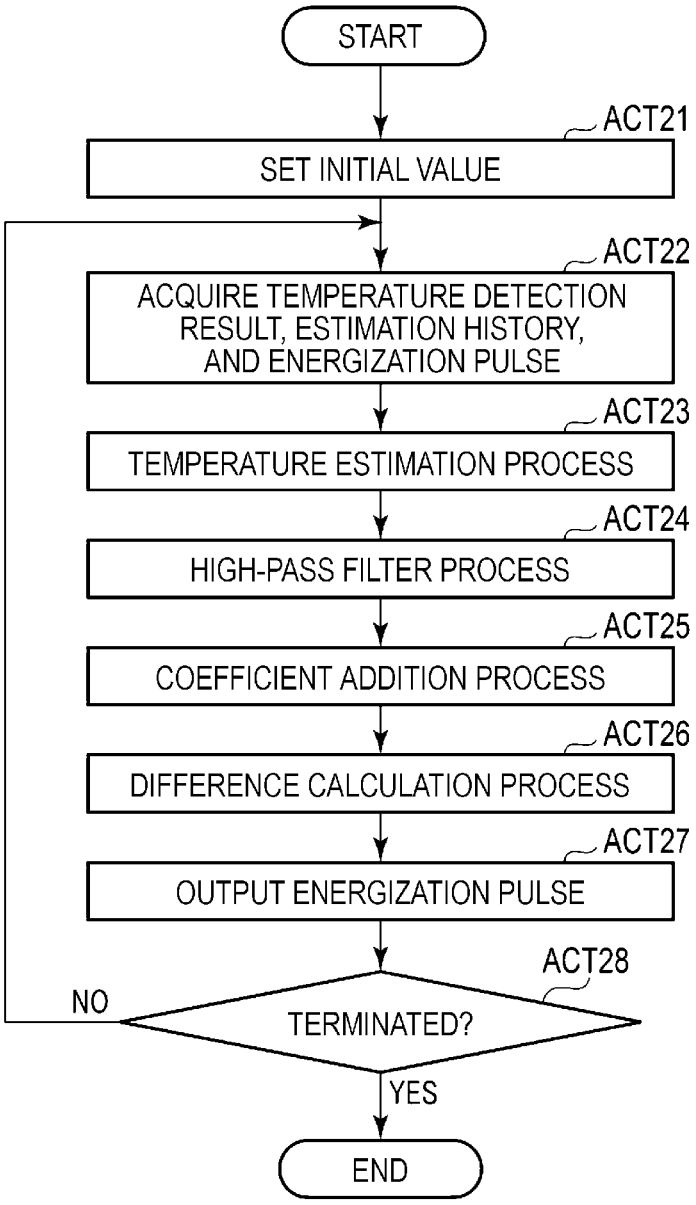
FIG. 4 is a flowchart for explaining WAE control.
Figure 5:
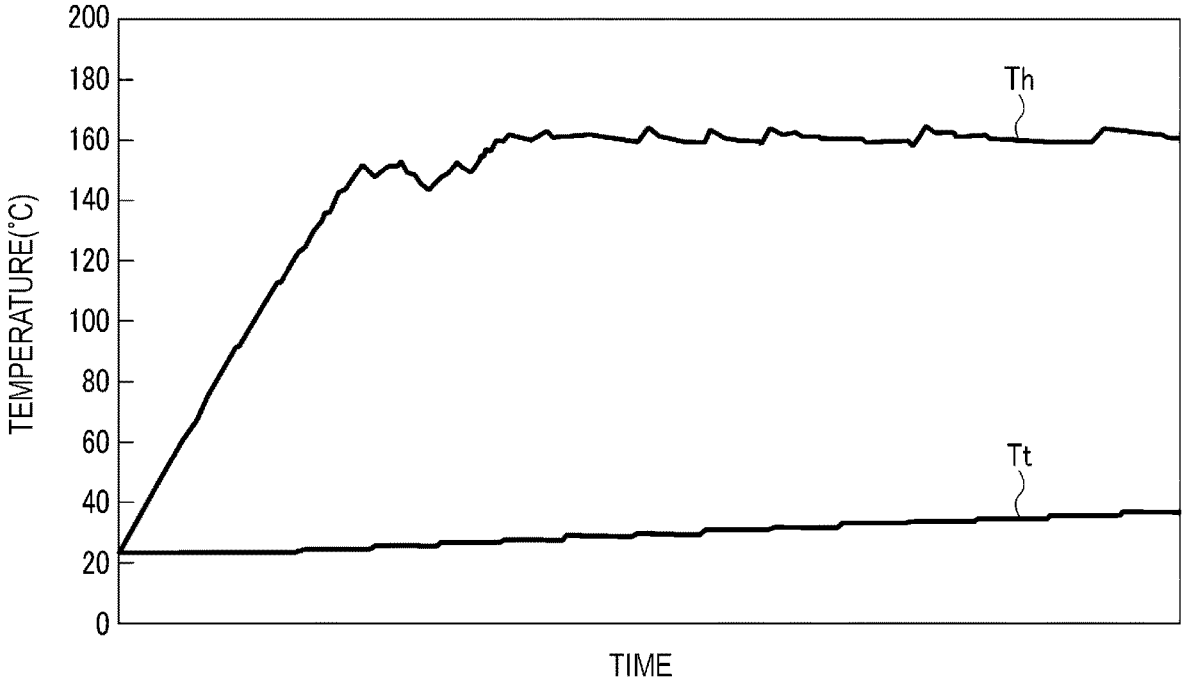
FIG. 5 is a diagram illustrating a relationship between an estimated temperature value of a heat roller and a temperature estimation value of a fixing device in the WAE control.

First, the WAE control will be described in detail with reference to the flowchart illustrated in FIG. 4. The WAE control is a subroutine of ACT 6 of the flowchart illustrated in FIG. 8. FIG. 5 is a diagram illustrating the relationship between the temperature estimation value Th of the heat roller and the fixing device temperature estimation value Tt of the fixing device in the WAE control.

The heater energization control circuit 14 sets various initial values (ACT 21). For example, the heater energization control circuit 14 sets the coefficient in the coefficient addition unit 84, the target temperature TGT of the target temperature output unit 85, and the like based on the signal from the system controller 13.

The temperature estimation unit 81 of the heater energization control circuit 14 acquires the temperature detection result Td from the temperature sensor 74, the estimation history PREV from the estimation history holding unit 82, and the energization pulse Ps from the control signal generation unit 87 (ACT 22). It is noted that, in FIG. 5, a surface temperature (temperature estimation value Th) of the heat roller 71 shows a fine change. In some cases, the temperature sensor 74 may have a slow response to temperature changes due to the influence of the heat capacity and the characteristics of a temperature-sensitive material, and the temperature detection result Td is detected in a state of being delayed with respect to the surface temperature (temperature estimation value Th) of the heat roller 71 or is detected in a state of being smoothed. In addition, the fixing device temperature estimation value Tt of the fixing device increases linearly, and becomes constant at, for example, approximately 55° C.

Next, the temperature estimation unit 81 performs a temperature estimation process (ACT 23). That is, the temperature estimation unit 81 generates the temperature estimation result EST based on the temperature detection result Td, the estimation history PREV, and the energization pulse Ps. The temperature estimation unit 81 outputs the temperature estimation result EST to the high-frequency component extraction unit 83 and the estimation history holding unit 82.

In general, heat transfer can be expressed equivalently by a CR time constant of an electric circuit. A heat capacity is replaced by a capacitor C. A heat transfer resistance is replaced by a resistance R. Also, a heat source is replaced by a DC voltage source. The temperature estimation unit 81 applies the energization amount to the heater 73, the heat capacity of the heat roller 71, and the like to a CR circuit in which the values of the elements are set in advance, and estimates the amount of heat to be given to the heat roller 71. The temperature estimation unit 81 estimates the surface temperature of the heat roller 71 based on the amount of heat given to the heat roller 71, the temperature detection result Td or the fixing device temperature estimation value Tt, and the estimation history PREV and outputs the temperature estimation result EST.

The temperature estimation unit 81 repeats energization and disconnection from the DC voltage source based on the energization pulse Ps, and the CR circuit operates in response to the input voltage pulse to generate an output voltage. Accordingly, the heat propagated to the surface of the heat roller 71, which is the temperature control target, can be estimated. It is noted that the heat of the heat roller 71 flows out to the external environment through the space (outside the heat roller 71) inside the fixing device 21. For this reason, the temperature estimation unit 81 further includes a CR circuit for estimating the outflow of heat from the heat roller 71 to the external environment. In addition, the temperature estimation unit 81 may further include a CR circuit for estimating the amount of heat flowing from the heat roller 71 to the space inside the fixing device 21.

The high-frequency component extraction unit 83 performs a high-pass filter process for extracting the high-frequency component of the temperature estimation result EST (ACT 24). The high-frequency component HPF, which is a signal indicating the high-frequency component of the temperature estimation result EST, follows the change in the surface temperature of the actual heat roller 71.

Next, the coefficient addition unit 84 performs a coefficient addition process which is correcting the temperature detection result Td (ACT 25). The coefficient addition unit 84 calculates the corrected temperature value WAE by multiplying the high-frequency component HPF and a preset coefficient and adding the high-frequency component HPF multiplied by the coefficient to the temperature detection result Td.

The coefficient addition unit 84 calculates the corrected temperature value WAE by adjusting the value of the high-frequency component HPF to be added to the temperature detection result Td with a coefficient. For example, if the coefficient is 1, the coefficient addition unit 84 directly adds the high-frequency component HPF to the temperature detection result Td. In addition, for example, if the coefficient is 0.1, the coefficient addition unit 84 adds a value of 1/10 of the high-frequency component HPF to the temperature detection result Td. In this case, the effect of the high-frequency component HPF is almost removed, and the temperature detection result is close to Td. In addition, for example, if the coefficient is 1 or more, the effect of the high-frequency component HPF can be expressed more strongly. Experimental results show that the coefficient set in the coefficient addition unit 84 is not a very extreme value, but a value near 1.

In the WAE control, a fine temperature change in the surface temperature of the heat roller 71 is estimated based on the temperature detection result Td and the high-frequency component HPF of the temperature estimation result EST. The corrected temperature value WAE is a value that appropriately follows the surface temperature of the heat roller 71.

The difference comparison unit 86 calculates the difference DIF between the target temperature TGT from the target temperature output unit 85 and the corrected temperature value WAE from the coefficient addition unit 84 and outputs the difference DIF to the control signal generation unit 87 (ACT 26).

The control signal generation unit 87 generates the energization pulse Ps based on the difference DIF. The control signal generation unit 87 outputs the energization pulse Ps to the power supply circuit 88 and the temperature estimation unit 81 (ACT 27). The power supply circuit 88 supplies the electric power PC to the heater 73 based on the energization pulse Ps.

From the difference DIF, a relationship between the target temperature TGT and the corrected temperature value WAE is known. For example, if the corrected temperature value WAE>the target temperature TGT, the energization amount to the heater 73 is decreased by controlling the width of the energization pulse Ps to be narrow or the frequency to be reduced, so that the surface temperature of the heat roller drops. In addition, if the corrected temperature value WAE<target temperature TGT, the energization amount to the heater 73 is increased by controlling the width of the energization pulse Ps to be wide or the frequency to be increased, so that the surface temperature of the heat roller rises.

It is noted that, from the difference DIF, it is possible to grasp not only a hierarchical relationship between the corrected temperature value WAE and the target temperature TGT but also how far the corrected temperature value WAE and the target temperature TGT are away. For example, if the difference DIF (absolute value) is a large value, the separation between the corrected temperature value WAE and the target temperature TGT is large, so that the above-mentioned control may be changed significantly. In addition, for example, if the difference DIF (absolute value) is a small value, the separation between the corrected temperature value WAE and the target temperature TGT is small, so that the above-described control may be performed gently.

The processor 22 of the system controller 13 determines whether or not to terminate the WAE control (ACT 28). If the processor 22 determines in ACT 28 that the WAE control is continued without termination (NO in ACT 28), the processor 22 proceeds to the above-mentioned process of ACT 22. On the other hand, if the processor 22 determines that the WAE control is terminated (YES in ACT 28), the processor 22 terminates the processing routine.

As described above, if the heater energization control circuit 14 performs a process of a certain cycle (the corresponding cycle), the heater energization control circuit 14 performs the WAE control based on the value (energization pulse Ps and temperature estimation result EST: estimation history PREV) in the previous cycle and the temperature detection result Ts in the corresponding cycle. That is, the heater energization control circuit 14 inherits the value in the next cycle. The heater energization control circuit 14 recalculates the estimated temperature based on the history of the previous calculation. Therefore, the heater energization control circuit 14 constantly performs the calculation during the operation. In the heater energization control circuit 14, the calculation result is stored in a memory or the like and reused in the calculation of the next cycle.

Figure 6:
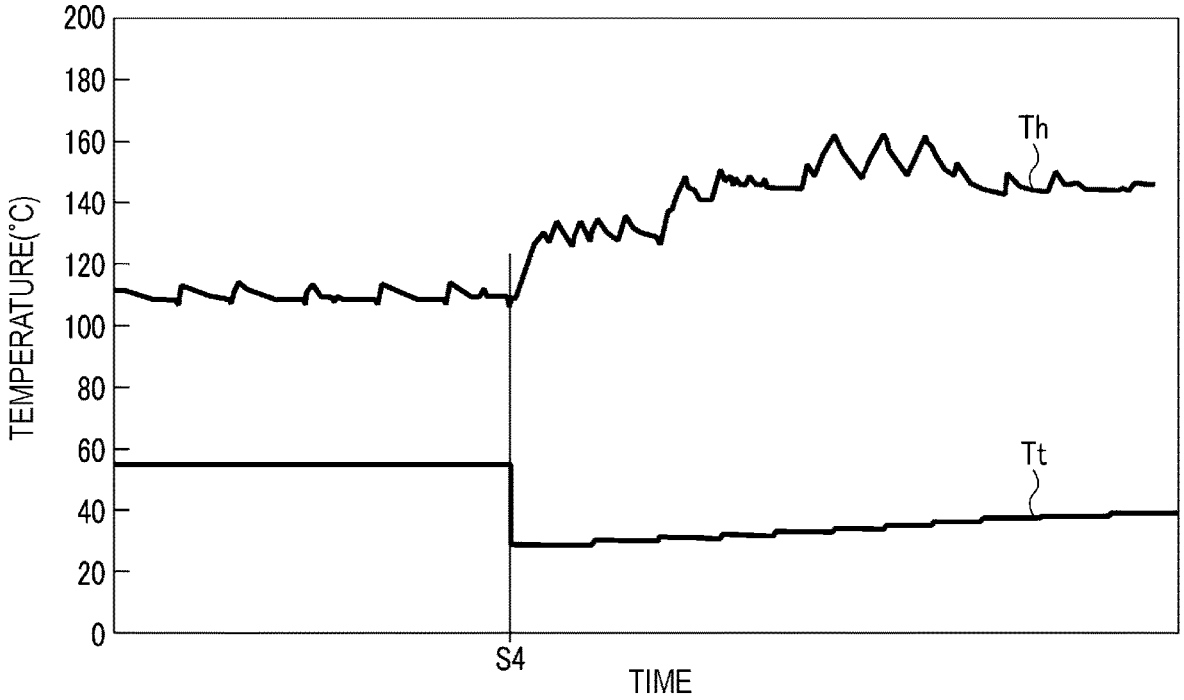
FIG. 6 is a diagram illustrating transitions of the temperature of the heat roller at the time of restart in the WAE control to which temperature is not applied and the temperature estimation value of the fixing device.
Figure 7:
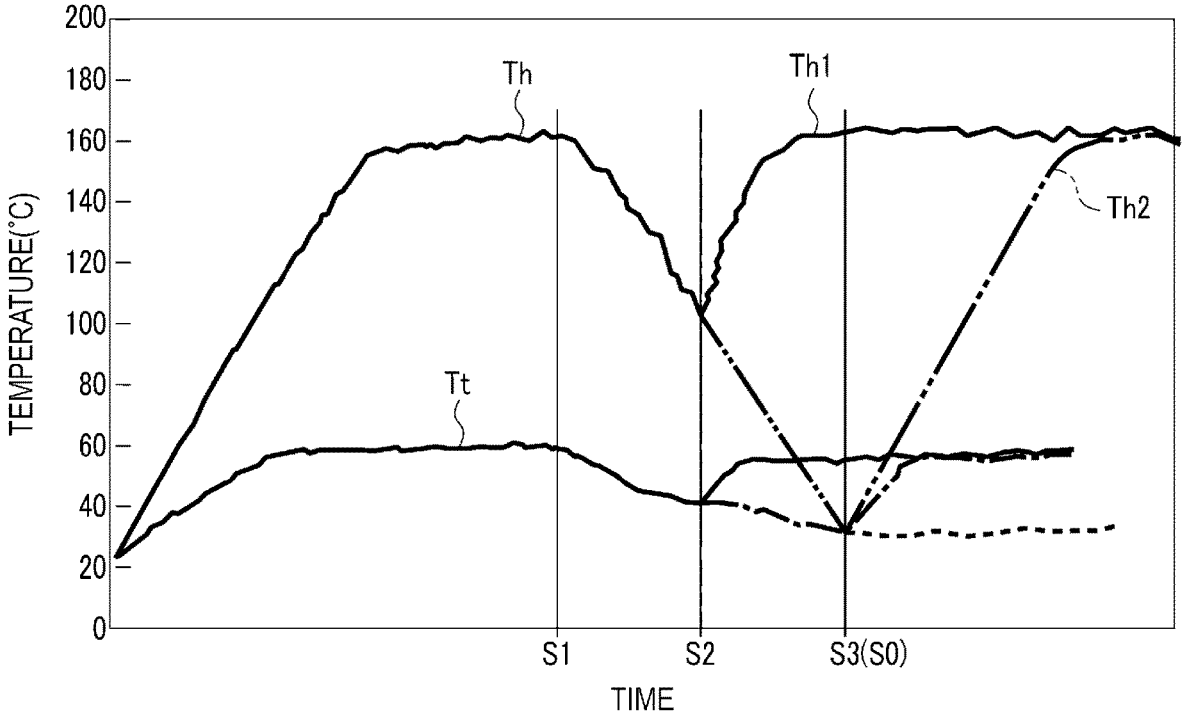
FIG. 7 is a diagram illustrating transitions of the temperature of the heat roller at the time of restart in the WAE control to which the temperature control is applied and the temperature estimation value of the fixing device.

Next, FIG. 6 is a diagram illustrating transitions of the temperature of the heat roller and the temperature of the fixing device when restarting at the time of warming up in the WAE control to which the temperature control of the present embodiment is not applied. FIG. 7 is a diagram illustrating transitions of the temperature of the heat roller and the temperature of the fixing device when restarting in the WAE control to which the temperature control of the present embodiment is applied.

FIG. 6 illustrates a temperature characteristic where, for example, if the electric power supplied to the heater 73 is continuously cut off and resupplied in a short time in a state where the image forming apparatus 1 normally warms up, for example, the OFF and ON operation of the main power switch 24 is switched in a short time. If the OFF and ON operation of the main power switch 24 occurs at the timing of time S4, the fixing device temperature estimation value Tt of approximately 55° C. of the fixing device 21 in the temperature estimation unit 81 is reset and is reset to 30° C. which corresponds to the room temperature as a preset initial set value. For this reason, the difference between the fixing device temperature estimation value Tt by the temperature estimation unit 81 and the temperature measurement value becomes large, so that the correct temperature estimation result EST cannot be generated.

The temperature characteristic in FIG. 6 described above shows a step difference indicating a reset (return to the initial state) in the temperature estimation value Tt of the fixing device 21. On the other hand, if the temperature control of the present embodiment is applied, even if a temporary power supply stops at the timing of time S4, since the WAE control using the fixing device temperature estimation value Tt before the stop is performed, both the temperature estimation value Th of the heat roller and the fixing device temperature estimation value Tt can be maintained at the previous temperature at time S4.

FIG. 7 illustrates the temperature estimation value Th of the heat roller at the time of start or restart and the fixing device temperature estimation value Tt of the fixing device after the power supply of the image forming apparatus 1 is stopped or after the electric power supply to the heater 73 is stopped due to transitioning to the sleep mode.

At the time S1 illustrated in FIG. 7, the power supply is stopped by the OFF operation of the main power switch 24. By stopping the power supply, the electric power supply to the heater 73 is also stopped, the temperature estimation value Th of the heat roller 71 drops, and the fixing device temperature estimation value Tt of the fixing device 21 also drops so as to return to the room temperature. Here, the set time set for comparison with the above-mentioned electric power supply stop period is set to time S3 (S0). If the set time S3 is reached, the temperature estimation value Th of the heat roller and the fixing device temperature estimation value Tt of the fixing device 21 also return to the room temperature.

In addition, if the main power switch 24 is turned on at time S2 before reaching the set time S3, the image forming apparatus is started and the electric power supply to the heater 73 is started. At the start, the fixing device temperature estimation value Tt generated before the stop and stored in the estimation value storage unit 89 is read, and the temperature estimation result EST equivalent to the temperature estimation result EST before the stop is generated from the temperature estimation unit 81. By performing WAE control using the temperature estimation result EST, the warming up is started with an appropriate temperature estimation value, and while preventing the phenomenon of overshoot and large temperature ripple, a temperature estimation value Th1 of the heat roller 71 reaches the same target temperature as last time. As the temperature estimation value Th of the heat roller 71 rises, the fixing device temperature estimation value Tt of the fixing device also rises.

In addition, if the apparatus is started by turning on the main power switch 24 after time S3 (S0), which is the set time for the fixing device temperature estimation value Tt of the fixing device 21 to return to the room temperature elapses, the state becomes the initial state in which the temperature Tt of the fixing device 21 is reset, the warm-up is performed to heat the heat roller 71 by the normal WAE control, and a temperature estimation value Th2 of the heat roller 71 reaches the target temperature Th.

Figure 8:
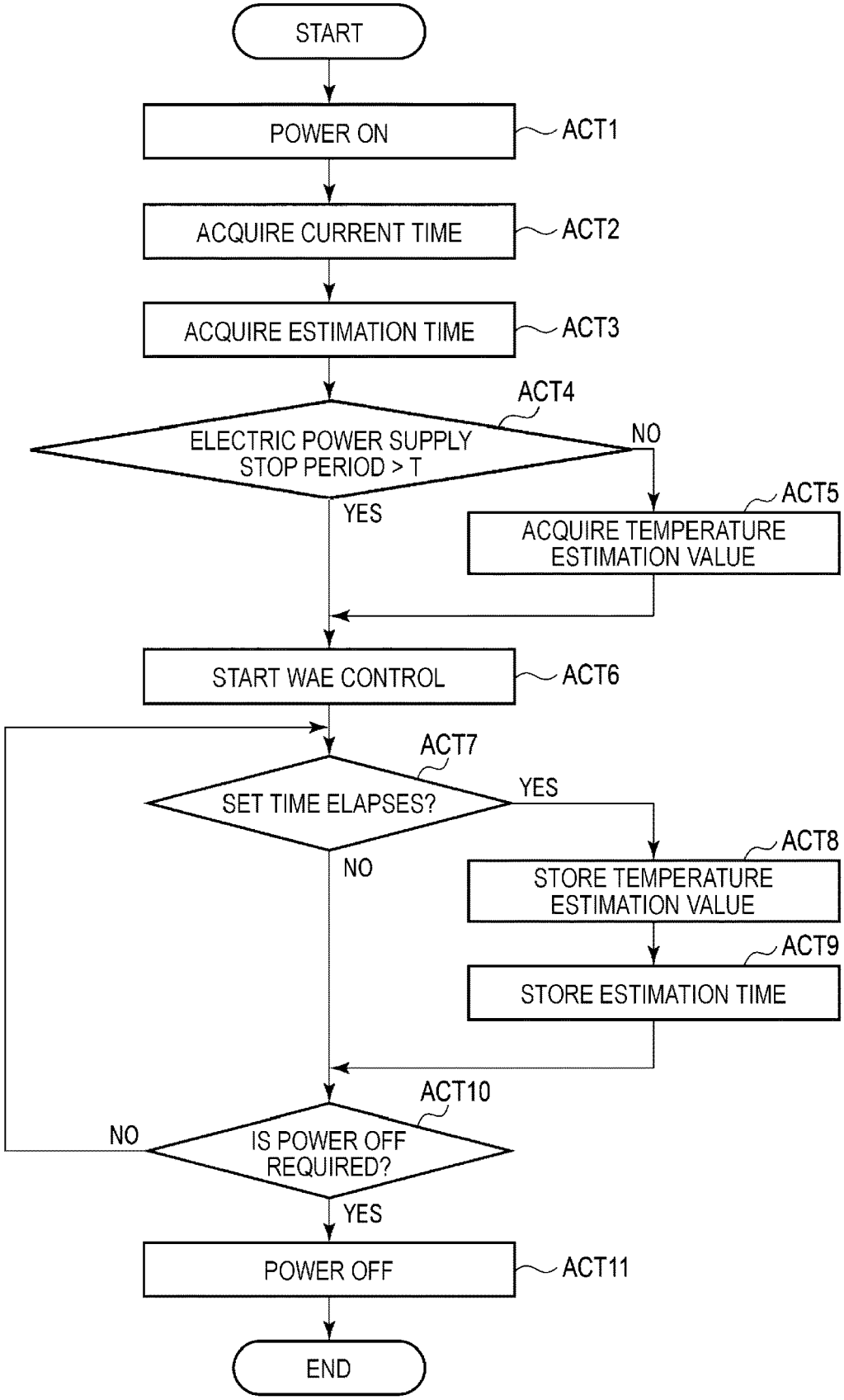
FIG. 8 is a flowchart for explaining the WAE control to which the temperature control is applied.

Next, the temperature control of the temperature control device according to the present embodiment will be described with reference to the flowchart illustrated in FIG. 8.

The temperature control device stores the fixing device temperature estimation value Tt output from the temperature estimation unit 81 and the estimation time in the estimation value storage unit 89 as a set to update the fixing device temperature estimation value Tt and the estimation time at each certain time in the WAE control before the start of the image forming apparatus 1 is stopped.

First, the main power switch 24 of the image forming apparatus 1 in the stopped state is turned on to start the apparatus (ACT 1). Alternatively, the image forming apparatus 1 in the sleep state is returned and restarted. By these start and restart, the electric power supply of driving to each component in the apparatus is started.

Next, the determination unit 90 acquires, for example, the start or restart time (electric power supply start time) from a clock function included in the processor 22 (ACT 2).

Subsequently, the determination unit 90 reads and acquires the estimation time stored in the estimation value storage unit 89 (ACT 3).

The determination unit 90 obtains the electric power supply stop period, which is a time from the acquired estimation time to the start or restart time. The determination unit 90 compares the electric power supply stop period with the preset set time T (for example, 60 minutes set in FIG. 5) (ACT 4). In the comparison, if the electric power supply stop period is shorter than the set time T (NO in ACT 4), the determination unit 90 determines that the temperature of the fixing device 21 does not drop to the room temperature, and the fixing device temperature estimation value stored in the estimation value storage unit 89 is read and acquired (ACT 5). The acquired fixing device temperature estimation value is output to the temperature estimation unit 81. On the other hand, in the above-described comparison, if the electric power supply stop period is equal to or longer than the set time T (YES in ACT 4), the determination unit 90 determines that the temperature of the fixing device temperature estimation value Tt of the fixing device 21 drops to an initial set value corresponding to the room temperature (for example, 30° C.) and the process proceeds to the next WAE control of ACT 6.

Next, if the temperature estimation unit 81 receives the fixing device temperature estimation value Tt stored at the time of start, the temperature estimation unit 81 starts the WAE control based on the fixing device temperature estimation value Tt, the estimation history PREV, and the energization pulse Ps to generate the temperature estimation result EST (ACT 6). In addition, after the temperature estimation result EST is obtained after the start, the WAE control is started based on the temperature detection result Td, the estimation history PREV, and the energization pulse Ps to generate the temperature estimation result EST. In addition, if it is determined in ACT 4 that the temperature of the fixing device 21 drops to the room temperature, the WAE control is started from the normal initial state based on the temperature detection result Td (room temperature), the estimation history PREV, and the energization pulse Ps set in advance as initial set values to generate the temperature estimation result EST.

Next, after the WAE control is started and the temperature estimation result EST is generated, it is determined whether or not a preset certain time (set time) elapses (ACT 7). If the elapsed time exceeds the set certain time (YES in ACT 7), the temperature estimation unit 81 stores the fixing device temperature estimation value Tt (ACT 8) estimated from the room temperature (ambient temperature) detected by the temperature sensor 76 and the temperature estimation value Th of the heat roller 71 and the estimation time (ACT 9) as a set so as to update the previously stored fixing device temperature estimation value Tt and the estimation time. The estimation value storage unit 89 basically stores the estimation time together with the latest fixing device temperature estimation value Tt, although the estimation value storage unit 89 depends on the length of the certain time.

Next, it is determined whether or not there is a power OFF request by the OFF operation of the main power switch 24 or a request to stop the power supply to the heater 7 for transitioning to the sleep state (ACT 10). If there is no power OFF request or electric power supply stop request in the determination (NO in ACT 10), the process proceeds to ACT 7, and the WAE control is continued. On the other hand, if there is a power OFF request or an electric power supply stop request (YES in ACT 10), the power is allowed to be turned off or the electric power supply is stopped (ACT 11), and the series of routines are terminated.

As described above, even if the fixing device is restarted in a state where the temperature of the fixing device is high due to the sleep mode or the power failure, the temperature control device of the present embodiment can generate an appropriate temperature estimation result EST by using the fixing device temperature estimation value Tt before stopping, and the WAE control can be started.

Therefore, even when restarting from power failure during operation or restarting due to interruption during warm-up, the accurate temperature estimation is performed without returning to the initial state, so that there is no difference between the measured value and the temperature estimation value, and the appropriate temperature control by the WAE control can be implemented.

The influence of the detection delay can be reduced by such WAE control, and thus, the phenomenon of the overshoot and the large temperature ripple can be prevented.

Second Embodiment

Next, an image forming apparatus according to a second embodiment will be described.

Figure 9:
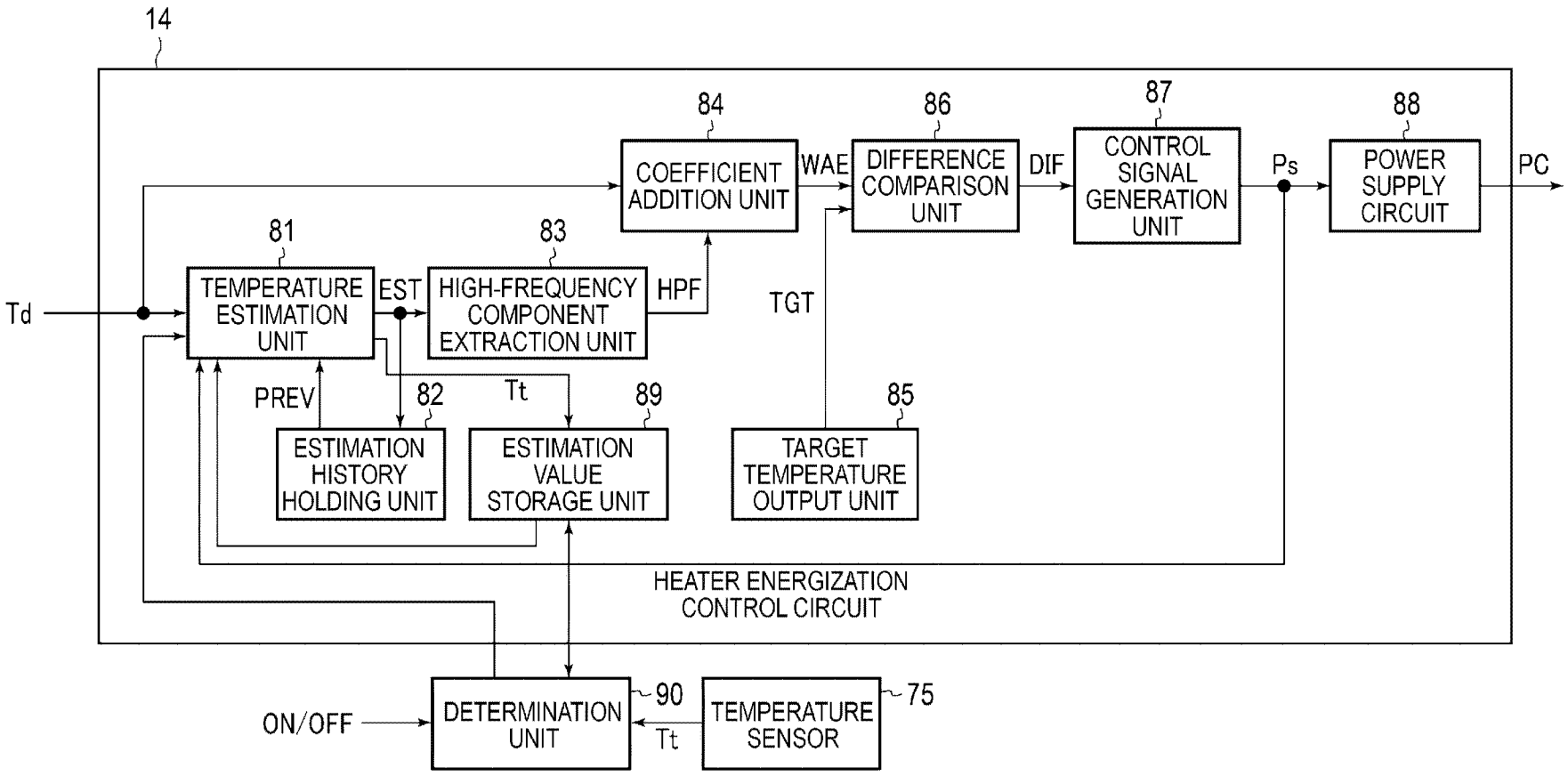
FIG. 9 is a block diagram illustrating a configuration example of a temperature control device according to a second embodiment.

FIG. 9 is a block diagram illustrating a configuration example of the temperature control device according to the second embodiment. In the present embodiment, a temperature sensor 75 that detects the ambient temperature of the fixing device 21 is included in addition to the configuration of the temperature control device according to the first embodiment described above. The temperature sensor 75 is attached to a frame or the like of the fixing device 21 to detect the temperature (ambient temperature) in the vicinity of the components including the heat roller 71, which is the temperature control target, and outputs the fixing device temperature estimation value Tt of the fixing device. The temperature sensor 75 outputs the detected fixing device temperature estimation value Tt to the determination unit 90.

In the first embodiment described above, if the power is turned on, the electric power supply stop period and the set time are compared, the temperature of the fixing device is estimated from the comparison result, and it is determined whether or not to use the fixing device temperature estimation value. On the other hand, in the present embodiment, if the power is turned on, it is determined whether or not to use the fixing device temperature estimation value by using the temperature Tt of the fixing device 21 detected by the temperature sensor 75.

The determination unit 90 acquires the fixing device temperature estimation value Tt of the fixing device 21 detected by the temperature sensor 75 if the image forming apparatus 1 is started from the stopped state or restarted from the sleep state.

Next, the determination unit 90 compares the acquired temperature Tt of the fixing device 21 with a preset initial set value. The initial set value used for the comparison is a room temperature or a normal temperature, for example, 30° C. If the temperature Tt of the fixing device 21 is higher than the initial set value, the determination unit 90 reads the fixing device temperature estimation value stored in the estimation value storage unit 89 and outputs the fixing device temperature estimation value to the temperature estimation unit 81. If the temperature estimation unit 81 receives the fixing device temperature estimation value, the temperature estimation unit 81 starts the WAE control to generate the temperature estimation result EST based on the fixing device temperature estimation value Tt, the estimation history PREV, and the energization pulse Ps at the time of start. It is noted that a comparison reference with the temperature Tt of the fixing device 21 is set to one room temperature, but the exemplary embodiments are not limited thereto, and the comparison reference may be set as a comparison reference having an upper limit and lower a limit range with respect to the initial set value. For example, it may be assumed that the room temperature is 30° C., and the temperature range of 5° C. between 27.5° C. and 32.5° C. may be set as the initial set value.

On the other hand, if the temperature of the fixing device 21 (fixing device temperature estimation value Tt) is equal to or lower than room temperature in the comparison, the determination unit 90 determines that the temperature of the fixing device 21 drops to the room temperature, and thus, the WAE control from the normal initial state without using the fixing device temperature estimation value Tt is started, and the temperature estimation unit 81 generates the temperature estimation result EST.

As described above, even if the temperature control device of the present embodiment is restarted in a state where the temperature of the fixing device is high due to the sleep mode or the power failure, the temperature control device calculates the heat roller estimation temperature by using the fixing device temperature estimation value before stopping, so that the WAE control can be performed by using the appropriate temperature estimation result EST.

Therefore, even when restarting from power failure during operation or when restarting due to interruption during warm-up, accurate temperature estimation is performed, so that there is no difference between the measured value and the temperature estimation value, and the appropriate temperature control by the WAE control is implemented.

The influence of the detection delay can be reduced by such WAE control, and thus, the phenomenon of the overshoot and the large temperature ripple can be prevented.

Summary of Second Embodiment

There is provided a temperature control device that controls a temperature of a temperature control target to which heat propagates from a heater by supplying electric power to the heater.

where the temperature control device includes:

a temperature estimation unit that estimates the temperature of the temperature control target based on energization of the heater;

an estimation value storage unit that updates a temperature estimation value estimated by the temperature estimation unit at each set time and stores the temperature estimation value;

a temperature sensor that detects an ambient temperature of the temperature control target;

a determination unit that compares the ambient temperature detected by the temperature sensor with a preset initial set value if a start instruction is input after electric power supply is stopped, determines that the temperature estimation value stored in the set value storage unit is used for temperature control if the ambient temperature is equal to or higher than the initial set value, and determines that the preset initial set value is used for the temperature control if the ambient temperature is lower than the initial set value; and a control signal generation unit that outputs an energization pulse for controlling the electric power supplied to the heater based on the temperature estimation result or the initial set value.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A temperature control device that controls a temperature of a temperature control target to which heat propagates from a heater by supplying electric power to the heater, the temperature control device comprising:

a temperature estimation component configured to estimate the temperature of the temperature control target based on energization of the heater;

an estimation value storage component configured to update a temperature estimation value based on a temperature estimation result estimated by the temperature estimation unit and an estimated estimation time at each set time and store the temperature estimation value;

a determination component configured to:

calculate a supply stop period from the estimation time to a time when the start instruction is input and compare the supply stop period with a predetermined set time when a new start instruction is input after electric power supply is stopped, determine that the temperature estimation value stored in the estimation value storage component is used for temperature control if the supply stop period is shorter than the set time, and determine that a preset initial set value is used for the temperature control if the supply stop period is equal to or longer than the set time; and a control signal generation component configured to output an energization pulse for controlling the electric power supplied to the heater based on the temperature estimation value, the initial set value, or the temperature estimation result.

2. The temperature control device according to claim 1, wherein the temperature estimation component is configured to estimate the temperature of the temperature control target based on a CR circuit in which a heat capacity of the temperature control target is replaced by a capacitor and a resistance of heat transfer is replaced by a resistor, the energization pulse, and the temperature estimation value or the initial set value.

3. The temperature control device according to claim 1, wherein the determination component is configured to determine that the temperature of the temperature control target is higher than the temperature of the initial set value if the supply stop period is shorter than the set time, and determine that the temperature of the temperature control target is equivalent to the temperature of the initial set value if the supply stop period is equal to or longer than the set time.

4. The temperature control device according to claim 1, wherein the set time is based on a time taken for the temperature to drop from the temperature of the temperature control target in an operation state to the temperature of the initial set value.

5. The temperature control device according to claim 1, wherein the set time used by the determination component for determination is a time taken for a fixing device to return from a temperature of the fixing device in the operating state to room temperature and obtained by measurement.

6. The temperature control device according to claim 1, wherein the temperature estimation result is generated by the temperature estimation component by allowing a normal WAE control based on an initial set value to be started without using a fixing device temperature estimation value stored in the estimation value storage component.

7. The temperature control device according to claim 1, wherein the heater is a halogen heater.

8. An image forming apparatus, comprising:

a fixing device having a fixing rotating body that heats a toner image formed on a medium and fixes the toner image on the medium and a heater that heats the fixing rotating body; and a temperature controller configured to control a temperature of the fixing rotating body to which heat propagates from the heater by supplying electric power to the heater, wherein the temperature controller includes:

a temperature estimation component configured to estimate the temperature of the fixing device based on energization of the heater;

an estimation value storage component configured to update a temperature estimation value based on a temperature estimation result estimated by the temperature estimation component and an estimated estimation time at each set time and store the temperature estimation value;

a determination component configured to:

calculate a supply stop period from the estimation time to a time when the start instruction is input and compare the supply stop period with a predetermined set time when a new start instruction is input after electric power supply is stopped, determine that the temperature estimation value stored in the estimation value storage component is used for temperature control if the supply stop period is shorter than the set time, and determine that a preset initial set value is used for the temperature control if the supply stop period is equal to or longer than the set time; and a control signal generation component configured to output an energization pulse for controlling the electric power supplied to the heater based on the temperature estimation value, the initial set value, or the temperature estimation result.

9. The image forming apparatus according to claim 8, wherein the temperature estimation component is configured to estimate the temperature of the temperature control target based on a CR circuit in which a heat capacity of the temperature control target is replaced by a capacitor and a resistance of heat transfer is replaced by a resistor, the energization pulse, and the temperature estimation value or the initial set value.

10. The image forming apparatus according to claim 8, wherein the determination component is configured to determine that the temperature of the temperature control target is higher than the temperature of the initial set value if the supply stop period is shorter than the set time, and determine that the temperature of the temperature control target is equivalent to the temperature of the initial set value if the supply stop period is equal to or longer than the set time.

11. The image forming apparatus according to claim 8, wherein the set time is based on a time taken for the temperature to drop from the temperature of the temperature control target in an operation state to the temperature of the initial set value.

12. The image forming apparatus according to claim 8, wherein the set time used by the determination component for determination is a time taken for the fixing device to return from a temperature of the fixing device in the operating state to room temperature and obtained by measurement.

13. The image forming apparatus according to claim 8, wherein the temperature estimation result is generated by the temperature estimation component by allowing a normal WAE control based on an initial set value to be started without using a fixing device temperature estimation value stored in the estimation value storage component.

14. The image forming apparatus according to claim 8, wherein the heater is a halogen heater.

15. A temperature control method for an image forming apparatus, comprising:

estimating a temperature of a temperature control target based on energization of a heater;

an estimation value storage component configured to updating a temperature estimation value based on a temperature estimation result estimated and an estimated estimation time at each set time and store the temperature estimation value;

calculating a supply stop period from the estimation time to a time when the start instruction is input and compare the supply stop period with a predetermined set time when a new start instruction is input after electric power supply is stopped;

determining that the temperature estimation value stored is used for temperature control if the supply stop period is shorter than the set time;

determining that a preset initial set value is used for the temperature control if the supply stop period is equal to or longer than the set time; and outputting an energization pulse for controlling the electric power supplied to the heater based on the temperature estimation value, the initial set value, or the temperature estimation result.

16. The temperature control method according to claim 15, further comprising:

estimating the temperature of the temperature control target based on a CR circuit in which a heat capacity of the temperature control target is replaced by a capacitor and a resistance of heat transfer is replaced by a resistor, the energization pulse, and the temperature estimation value or the initial set value.

17. The temperature control method according to claim 15, further comprising:

determining that the temperature of the temperature control target is higher than the temperature of the initial set value if the supply stop period is shorter than the set time, and determining that the temperature of the temperature control target is equivalent to the temperature of the initial set value if the supply stop period is equal to or longer than the set time.

18. The temperature control method according to claim 15, wherein the set time is based on a time taken for the temperature to drop from the temperature of the temperature control target in an operation state to the temperature of the initial set value.

19. The temperature control method according to claim 15, wherein the set time used for determination is a time taken for a fixing device to return from a temperature of the fixing device in the operating state to room temperature and obtained by measurement.

20. The temperature control method according to claim 15, wherein the temperature estimation result is generated by allowing a normal WAE control based on an initial set value to be started without using a fixing device temperature estimation value stored.

* * * * *